US005196108A

United States Patent [19]

Wilmeth et al.

[11] Patent Number: 5,196,108

[45] Date of Patent: Mar. 23, 1993

[54] SUCKER ROD OIL WELL PUMP

[75] Inventors: Thomas S. Wilmeth; Jesse L. Eades, both of Daingerfield, Tex.

[73] Assignee: Scot Industries, Inc., Lone Star, Tex.

[21] Appl. No.: 690,703

[22] Filed: Apr. 24, 1991

[51] Int. Cl.[5] ..... C25D 3/56; C25D 3/04

[52] U.S. Cl. ..... 205/243; 205/287; 205/290

[58] Field of Search ..... 205/243, 290, 283, 287

[56] References Cited

U.S. PATENT DOCUMENTS

| | | | |
|---|---|---|---|
| 2,516,227 | 7/1950 | Ma | 205/243 |
| 3,657,079 | 4/1972 | Chessin et al. | 205/290 |
| 3,745,097 | 7/1973 | Chessin et al. | 205/285 |
| 4,588,481 | 5/1986 | Chessin et al. | 205/290 |
| 5,009,000 | 4/1991 | Wilmeth et al. | 92/162 R |

FOREIGN PATENT DOCUMENTS

| | | |
|---|---|---|
| 2-47285 | 2/1990 | Japan . |
| 2153387A | 8/1985 | United Kingdom . |

*Primary Examiner*—John Niebling
*Assistant Examiner*—Brian M. Bolam
*Attorney, Agent, or Firm*—Charles D. Gunter, Jr.

[57] ABSTRACT

A method is shown for constructing portions of a sucker rod pump of the type having a steel plunger with an exterior cylindrical wall and a barrel with a cylindrical bore. A chromium case if formed on the cylindrical bore to a selected depth for receiving the plunger in sliding contact. The chromium case is formed by forming a base electrolyte bath including water, chromic acid, a sulfate component, an alkyl sulphonic acid, and an anion of molybdenum. The bore is then exposed to the aqueous electrolyte bath at a current density and at a plating temperature sufficient to form a chromium deposit of desired thickness on the bore.

11 Claims, 2 Drawing Sheets

SUCKER ROD OIL WELL PUMP

BACKGROUND OF THE INVENTION

1. Cross-reference to Related Applications

The present application is related to the co-pending application of Thomas S. Wilmeth, Steven L. Wilmeth and Frances E. Foster entitled METHOD FOR MAKING SUCKER ROD OIL PUMP, U.S. patent application Ser. No. 07/383,019, filed Jul. 19, 1989.

2. Field of the Invention

This invention relates generally to sucker rod oil well pumps of the type having hardened metal layers on the plunger and barrel components thereof and, more specifically, to an improved chrome plating process for depositing a chromium deposit of desired thickness on the barrel of such a sucker rod pump.

3. Description of the Prior Art

Sucker rod well pumps have been in wide use for many years. A barrel is mounted to the tubing. The barrel has a smooth cylindrical bore. A plunger is positioned inside the tubing and connected to the sucker rod. The sucker rod is reciprocated up and down to move the plunger in the barrel. A stationary check valve is located at the bottom of the barrel. A traveling valve is located at the bottom of the plunger. The valves cooperate on the downstroke and upstroke to pump fluid from the well to the surface.

The mating surfaces between the plunger and barrel provide a very close fit. In wells which produce abrasive particles, such as quartz or sand, these particles can quickly damage the mating surfaces. The wear due to the abrasive particles will cause leakage past the plunger. This necessitates the pump being pulled for replacement at fairly frequent intervals.

Various techniques have been used in the past to increase wear resistance. In one technique, a chrome case is plated on either of the barrel or the plunger. Circumferential grooves have also been formed in the plunger.

In the previously referenced application entitled METHOD FOR MAKING SUCKER ROD OIL WELL PUMP, U.S. patent application Ser. No. 07/383,019, filed Jul. 19, 1989, a sucker rod pump is shown having hardened layers to increase wear resistance. The barrel has a chromium case plated on its bore and a plunger which has a boronized case. The plunger also has circumferential grooves spaced-apart from each other. The chromium case is plated in a conventional manner, except that it is about twice the thickness of the chromium cases placed in conventional barrels of sucker rod pumps. Preferably, the layer is from about 0.006 to 0.008 thickness on each side.

Despite the previous advances, a need exists for a process for improving the wear resistance of the components of a sucker rod well pump in order to extend the useful life thereof.

SUMMARY OF THE INVENTION

In the present invention, a method is shown for chrome plating a workpiece, such as a component of a sucker rod pump, from an aqueous electrolyte bath. The method includes the steps of forming a base electrolyte bath by combining water, chromic acid, a sulfate component and an alkyl sulphonic acid. The method also includes the step of adding a molybdenum anion such as ammonium molybdate or any other suitable molybdenum compound to produce an anion to the base electrolyte bath. The workpiece is then exposed to the aqueous electrolyte bath at a current density and at a plating temperature sufficient to form a chromium deposit of desired thickness on the workpiece.

In the preferred method of constructing portions of a sucker rod pump for a well, a steel plunger is provided having an exterior cylindrical wall. A barrel is provided having a cylindrical bore. A chromium case is formed on the cylindrical bore of the barrel to a selected depth for receiving the plunger in sliding contact. The chromium case is formed by forming a base electrolyte bath comprising water, chromic acid, a sulfate component, an alkyl sulphonic acid, a molybdenum anion, and by exposing the bore to the aqueous electrolyte bath a current density and at a plating temperature sufficient to form a chromium deposit of desired thickness on the bore.

The alkyl sulphonic acid is preferably a saturated aliphatic sulphonic acid having a maximum of two carbon atoms and a maximum of six sulphonic acid groups, their salts or halogen derivatives thereon. Most preferably, the sulphonic acid is methylsulphonic acid. The bath temperature is maintained in the range from about 20° to 70° C. and the current density is maintained in the range from about 50 to 100 A/dm$^2$. By using pulsed D.C. current and adding boric acid or a borate to the base electrolyte bath, the efficiency of the plating process can be further improved.

Additional objects, features and advantages will be apparent in the written description which follows.

DETAILED DESCRIPTION OF THE INVENTION

Figure 1:
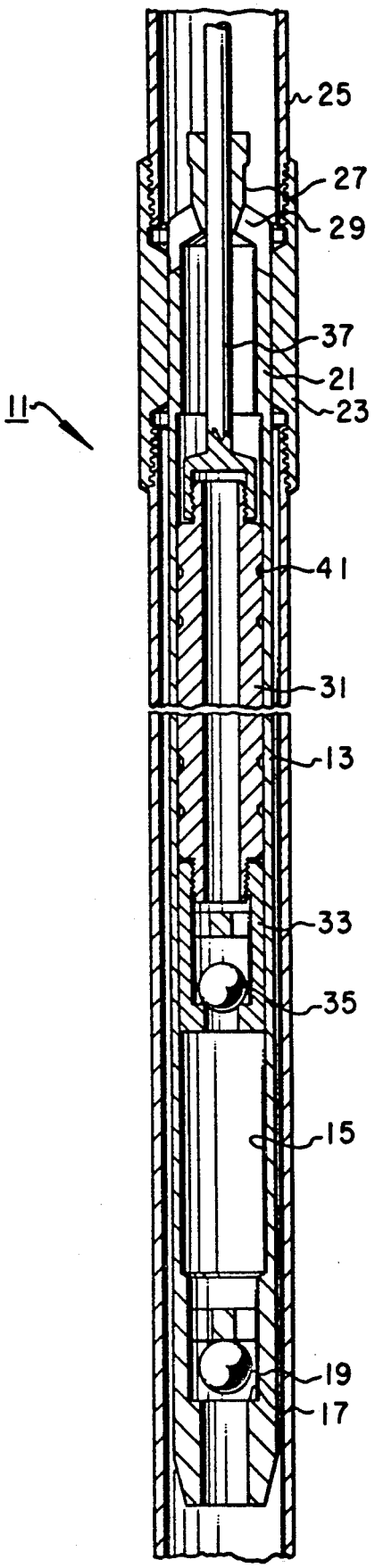
FIG. 1 is a vertical sectional view illustrating a sucker rod oil well pump with components thereof constructed in accordance with the method of this invention and with some of the portions being schematically shown.

Referring to FIG. 1, the sucker rod pump 11 includes a barrel 13. The barrel is a thin wall tubular member. It has a cylindrical bore 15. Normally, the barrel 13 is formed of steel. As will be discussed in greater detail, an improved case is plated on the bore 15.

A standing valve 17 is located on the bottom of the barrel 13. A ball 19 is part of the standing valve 17. A hold-down 21 is located on the upper end of barrel 13 in the embodiment shown. The hold-down 21 is not shown in detail, however, it has latches and seals for sealing releasably in a seating nipple 23. The seating nipple 23 is connected into the string of tubing 25. Barrel 13 is thus located within the string of tubing 25. A cage 27 is located on the upper end of the hold-down 21. Cage 27 has ports 29 to allow well fluid to flow into the tubing 25 and to the surface.

A plunger 31 is reciprocally carried inside the barrel 13. The clearance between the plunger 31 and the bore 15 is very small. Plunger 31 is a tubular steel member. It has a traveling valve 33 located on the lower end. Traveling valve 33 includes a ball 35. The upper end of plunger 31 is connected to the lower end of a string of sucker rod 37 that extends to the surface. Sucker rod 37 passes through the cage 27.

Figure 2:
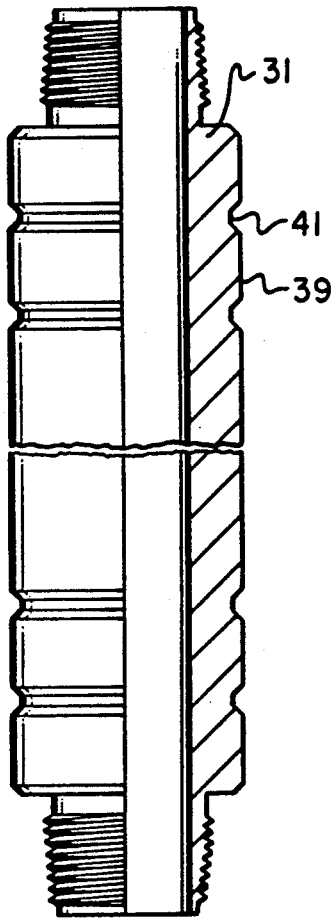
FIG. 2 is a partially sectioned, enlarged view of a plunger for the well pump of FIG. 1.

With reference to FIG. 2, the plunger 31 has a cylindrical wall 39. A plurality of parallel circumferential grooves 41 are preferably formed in the wall. Grooves 41 are not shown to scale in FIG. 2. Preferably, each groove 41 is about ⅛ inch in vertical dimension and ⅛ inch depth. Preferably there are two grooves 41 near the top of plunger 31 and two near the bottom of plunger 31. The grooves 41 in each pair are preferably about ¾ inch apart. There may be other grooves 41 along the length of the plunger 31 between the pairs at the top and the bottom. Each of these other grooves 41 are preferably about 6 to 8 inches apart from each other.

After the grooves 41 are formed and before any hardening, a boronized case is formed on the cylindrical wall 39. The boronized case is formed in a conventional manner by fluidized bed techniques. In this technique, as is known to those skilled in the art, the plunger 31 will be heated to about 1,800° F. For about four hours while immersed in a fluidized bed containing boronizing powder. This produces a boronized case that is about 0.003 to 0.010 inch in thickness. The boronized case may be formed by other methods including packing the plunger in boronizing powder, by liquid boronizing or other known techniques.

Then the plunger 31 is hardened to harden the steel supporting layer beneath the boronized case. The preferred technique is by using induction hardening, which is a known process. In induction hardening, the plunger 31 is passed through a coil (not shown). The coil has high frequency alternating current passing through it. This heats a surface layer of the plunger 31. The rate at which the plunger 31 passes through the induction coil, and the power supplied to the induction coil, are controlled so that the temperature in a surface layer of the cylindrical wall 39 will be above about 1,800° F. This layer extends about 0.030 to 0.050 inch deep measured from the exterior of the cylindrical wall 39 and supports the boronized case.

A quenching ring (not shown) is located on the induction hardening apparatus immediately behind the coil. The quenching ring discharges water onto the plunger 31 to quench the heated layer and harden it. This results in a hardened layer of steel supporting the boronized case. The hardened layer is about 0.030 to 0.050 inches deep.

The hardness of the hardened steel layer beneath the boronized case will be about 55 to 60 Rockwell "C." The hardness at the surface of the boron case will be 18 over 80 Rockwell "C" and is typically measured on the Knoop scale. On the Knoop scale, the hardness of the boron case will be within the range from about 1,500 to 1,650.

As has been discussed, a chromium case is normally plated on the bore 15 of the barrel 13. In the past, the chromium case was plated in a convention manner, except that it was about twice the thickness of the chromium cases placed in conventional barrels of sucker rod pumps. The layer was from about 0.006 to 0.008 thickness on each side. This resulted in a hardness at the surface of approximately 68 to 70 Rockwell "C."

In the method of the present invention, an improved chrome plating process is utilized to produce a workpiece, such as a component of a sucker rod pump, having improved wear resistance over workpieces plated according to the prior art processes. Within the scope of the present invention "metal alloy" particularly signifies steel (iron alloys) and aluminum alloys.

Functional hexavalent chromium plating baths containing chromic acid and sulfate as a catalyst generally permit the deposition of chromium metal on the base metal at cathode efficiencies of between about 12% and 16% at temperatures between about 52° C. to 68° C. and at current densities from about 30 to about 50 A/dm$^2$. Typical state-of-the-art chromium plating baths are described, for instance, in U.S. Pat. No. 3,745,097, issued Jul. 10, 1973 and U.S. Pat. No. 4,588,481, issued May 13, 1986. The functional chromium plating baths shown therein deal with regularly shaped articles where rapid plating at high current efficiency and at useful current densities are important. In addition to water, chromic acid and sulfate component, these baths include the addition of an alkyl sulphonic acid, such as methane sulphonic acid, to increase plating efficiency.

In the process of the invention, hard chromium is deposited on workpieces of metal alloy from an aqueous electrolyte containing chromic acid and a sulfate component such as sulfuric acid, namely from the classical chromium bath with $CrO_3$ content of about 150 to 400 grams per liter, preferably about 250 to 300 grams per liter, and an $SO_4$ content of about 2 to 15 grams per liter, preferably about 2 to 4 grams per liter. The base electrolyte bath of the present invention also includes, as one component, an alkyl sulphonic acid. Preferably, the alkyl sulphonic acid is a saturated aliphatic sulphonic acid with a maximum of two carbon atoms and a maximum of six sulphonic acid groups or their salts or halogen derivatives. Members of the above class of organic compounds include methane sulphonic acid, ethane sulphonic acid, methane disulphonic acid, 1,2-ethane disulphonic acid, salts of the above mentioned acids or halogen derivatives. Most preferably, the organic compound is methane sulphonic acid, present in the range from about 1 to 18 grams per liter, most preferably about 2 to 4 grams per liter.

In addition to the above listed components of the base electrolyte bath, the method of the invention includes the addition of an anion of molybdenum such as ammonium molybdate to the base electrolyte bath in the range from about 10 to 100 grams per liter, most preferably about 25 to 50 grams per liter. The addition of the molybdenum anion materially changes the fundamental character of the base electrolyte bath, providing a workpiece with improved wear resistance obtainable at high current efficiency and at a useful current density.

In addition to the above listed components, the base electrolyte bath can also contain other enhancement additives. For instance, the base electrolyte bath can contain boric acid or borates in the range from about 4 to 40 grams per liter, most preferably about 6 to 12 grams per liter boric acid. The addition of boric acid or borates has the effect of increasing the hardness and increasing the cracks per unit area from about 500 cracks/cm$^2$ to about 2,000 cracks/cm$^2$ or more. Microcracks, instead of larger cracks, tend to increase the corrosion resistance of the chrome.

The following example is intended to be illustrative of the invention without limiting the scope thereof:

An electrolyte bath is prepared having the following composition:

2–4 grams per liter methane sulphonic acid;
2–4 grams per liter sulfuric acid;
250–300 grams per liter chromic acid; and
6–12 grams per liter boric acid;
25–50 grams per liter ammonium molybdate or other molybdenum salt producing an anion.

At a current density in the range from about 2 to 6 Amps/in$^2$ and at a plating temperature of about 135° F., a cathode efficiency of about 18 to 20% is realized. Where about 10 to 100 grams per liter of ammonium molybdate, preferably about 25 to 50 grams per liter, are added to the plating bath, an alloy chrome is produced with about one half percent molybdenum and about twice the wear life of the prior art workpiece. If pulsed D.C. current is used, about one and one half percent molybdenum is deposited.

Figure 3:
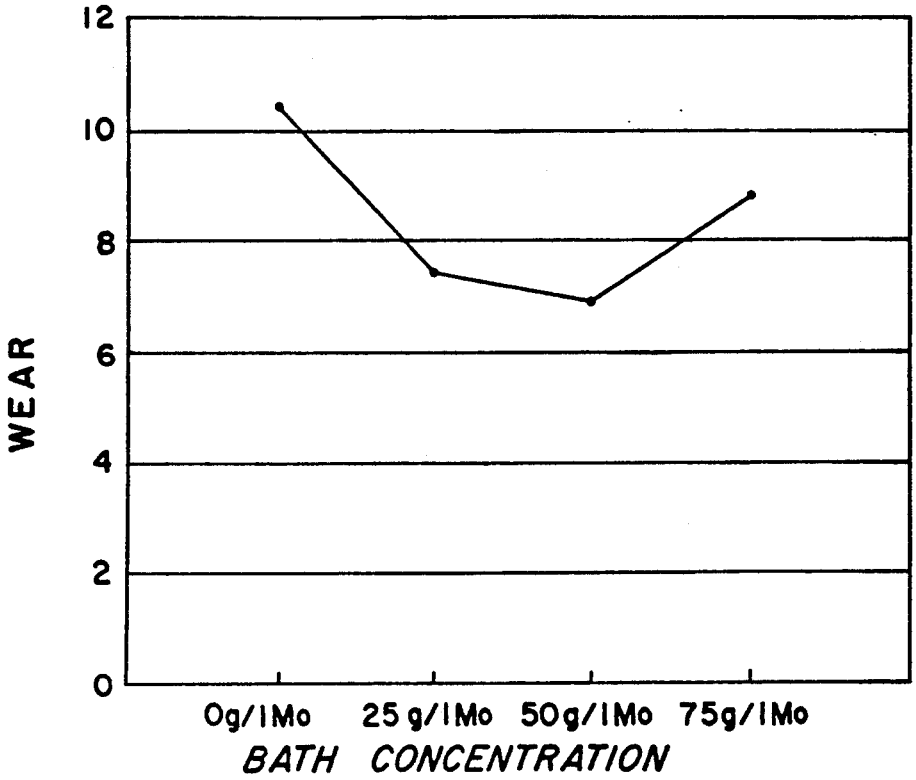
FIG. 3 is a graph of Taber wear tests conducted on an improved pump component of the invention illustrating milligrams of weight loss per 5,000 cycles on the vertical scale versus molybdenum concentration of the plating bath on the horizontal scale.

FIG. 3 illustrates the Taber wear test data obtained from a workpiece prepared with the chrome plating process of the invention, the graph illustrating the milligrams of weight loss per 5,000 cycles on the vertical axis versus the amount of molybdenum added to the bath on the horizontal axis. The data was obtained in accordance with the procedure outlined in Mil-A-8625D Federal Test Method Standard 141 Method 6192. The optimum wear resistance appears to be obtained by adding about 25 to 50 grams per liter ammonium molybdate.

Figure 4:
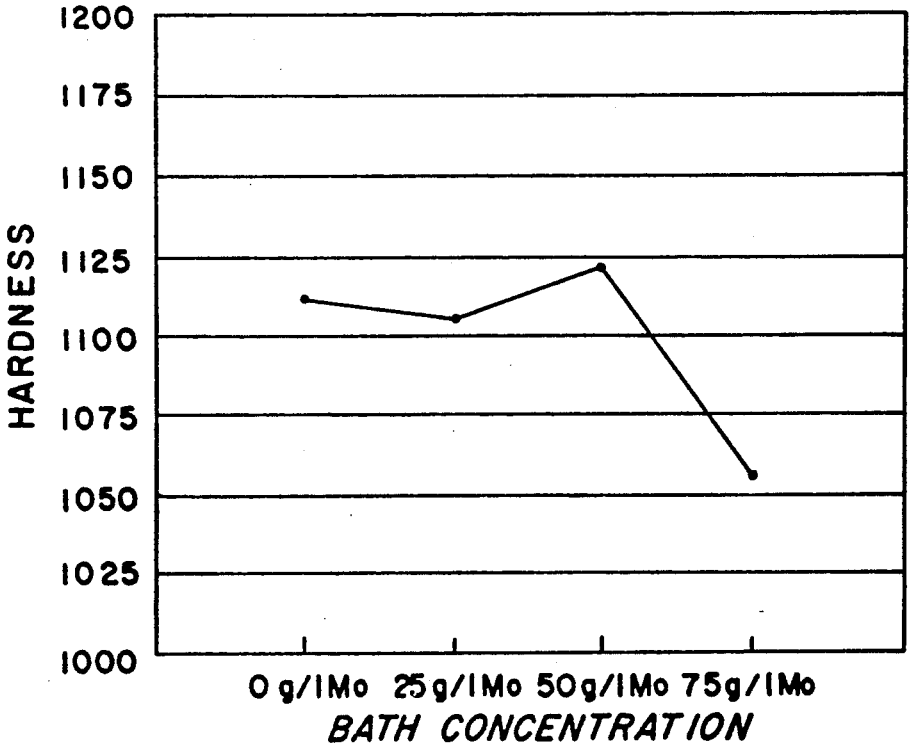
FIG. 4 is a graph of Knoop hardness tests performed on the same pump component illustrating Knoop hardness for a 100 gram load on the vertical scale versus the concentration of molybdenum on the horizontal scale.

FIG. 4 is a graph of Knoop hardness data for a workpiece prepared according to the method of the invention illustrating hardness on the vertical scale and amount of ammonium molybdate added to the bath on the horizontal scale. The data was obtained in accordance with the procedure outlined in ASTM E-384. Again, the optimum results are obtained by adding about 25 to 50 grams per liter of ammonium molybdate or other anion of molybdenum to the base electrolyte bath.

In the preferred method of the invention, portions of a sucker rod pump for a well are chrome plated. Specifically, a steel plunger is provided with an exterior cylindrical wall. A barrel is provided with a cylindrical bore. A chromium case is formed on the cylindrical bore to a selected depth for receiving the plunger in sliding contact. The chromium case is formed by forming the base electrolyte bath previously described including water, chromic acid, a sulfate component and an alkyl sulphonic acid. The bath also includes ammonium molybdate or other anion of molybdenum in the preferred ranged specified. The barrel of the pump is exposed to the aqueous electrolyte bath at a current density and at a plating temperature sufficient to form a chromium deposit of desired thickness on the bore.

In operation, the pump 11 is placed in the tubing 25 and secured by the hold-down 21 in the seating nipple 23. A pump-jack (not shown) at the well surface reciprocates the rod 37 and the plunger 31. As the plunger 31 moves downward, well fluid contained in the barrel 13 will flow past the ball 35 into the interior of the plunger 31. On the downstroke, the ball 19 will seat on the seat 17. On the upstroke, the well fluid contained inside the plunger 31 will be pushed upward through the ports 29 into the tubing 25. Suction created by the upward movement of the plunger 31 lifts the ball 19. This allows well fluid in the tubing 25 below the barrel 13 to be drawn into the barrel 13.

Abrasive particles tend to be trapped in the grooves 41. The grooves 41 also help equalize hydrostatic pressure around the plunger 31. The boron case on the plunger 31 and the improved chromium case on the barrel 13 are both harder than most abrasive particles expected to be found in the well.

An invention has been provided with several advantages. The boronized case and improved chromium case are harder than the particles found in the well and wear resistance of the pump components is greatly improved, thereby extending the useful life of the pump. The improved chromium plating process provides improved hardness and wear resistance for the pump component and improves the cathodic efficiency of the plating process at a useful current density.

While the invention has been shown in only one of its forms, it is not thus limited but is susceptible to various changes and modifications without departing from the spirit thereof.

What is claimed is:

1. A method for alloy chrome plating a workpiece from an aqueous electrolyte bath, comprising the steps of:

forming a base electrolyte bath by combining water, from about 250 to 300 grams per liter chromic acid, from about 2 to 4 grams per liter of a sulfate component and about 2 to 4 grams per liter of an alkyl sulphonic acid;

adding from about 25 to 50 grams per liter of a source of molybdenum anions to the base electrolyte bath;

exposing the workpiece to the aqueous electrolyte bath at a current density and at a plating temperature sufficient to form an alloy chromium deposit of desired thickness on the workpiece.

2. The method of claim 1, wherein the alkyl sulphonic acid is a saturated aliphatic sulphonic acid having a maximum of two carbon atoms and a maximum of six sulphonic acid groups or their salts or halogen derivatives thereon.

3. The method of claim 2, wherein the bath temperature is in the range from about 20 to 70 degrees C. and the current density is in the range from about 15 to 100 A/dm$^2$.

4. The method of claim 1, further characterized in that the cathode efficiency of the process is greater than about 18%.

5. The method of claim 1, further comprising the step of adding to the electrolyte bath boric acid or a borate in a concentration of about 4 to 40 grams per liter, the boric acid being added in concentration effective to increase the cracks per unit area of the workpiece from abut 500 cracks/cm$^2$ to at least about 2,000 cracks/cm$^2$.

6. A method for chrome plating a workpiece from an aqueous electrolyte bath, comprising the steps of:

forming a base electrolyte bath by combining water, about 250 to 300 grams/liter chromic acid, about 2 to 4 grams/liter sulfuric acid, about 2 to 4 grams/liter of an alkyl sulphonic acid and about 6 to 12 grams/liter boric acid;

adding about 25 to 50 grams/liter of ammonium molybdate or other anion of molybdenum to the base electrolyte bath;

exposing the workpiece to the aqueous electrolyte bath at a current density in the range from about 15 to 100 A/dm$^2$ and at a plating temperature in the range from about 20 to 70 degrees C. to form an alloy chromium deposit having at least about 0.5% molybdenum deposited.

7. The method of claim 6, wherein the current applied to the aqueous electrolyte bath is applied as pulsed direct current to provide an alloy chromium deposit having at least about 1.5% molybdenum deposited.

8. A method of constructing portions of a sucker rod pump for a well, comprising the steps of:

providing a steel plunger with an exterior cylindrical wall;

forming a plurality of spaced apart circumferential grooves in the exterior cylindrical wall;

forming a boronized case on the exterior cylindrical wall;

providing a barrel with a cylindrical bore; and forming a chromium case on the cylindrical bore to a selected depth for receiving the plunger in sliding contact, the chromium case being formed by forming a base electrolyte bath comprising water, from about 250 to 300 grams per liter of chromic acid, from about 2 to 4 grams per liter of a sulfate component, from about 2 to 4 grams per liter of an alkyl sulphonic acid and from about 25 to 50 grams per liter of ammonium molybdate or other anion of molybdenum and by exposing the bore to the aqueous electrolyte bath at a current density and at a plating temperature sufficient to form a chromium deposit of desired thickness on the bore.

9. The method of claim 8, wherein the alkyl sulphonic acid is a saturated aliphatic sulphonic acid having a maximum of two carbon atoms and a maximum of six sulphonic acid groups or their salts or halogen derivatives thereon.

10. The method of claim 9, wherein the bath temperature is in the range from about 20 to 70 degrees C. and the current density is in the range from about 15 to 100 $A/dm^2$.

11. The method of claim 10, further comprising the step of adding to the electrolyte bath boric acid or a borate in a concentration of about 4 to 40 grams per liter.

* * * * *